US007182138B2

(12) United States Patent
Behrmann et al.

(10) Patent No.: US 7,182,138 B2
(45) Date of Patent: Feb. 27, 2007

(54) RESERVOIR COMMUNICATION BY CREATING A LOCAL UNDERBALANCE AND USING TREATMENT FLUID

(75) Inventors: Lawrence A. Behrmann, Houston, TX (US); Joseph A. Ayoub, Katy, TX (US); Ian Walton, Sugar Land, TX (US); Adinathan Venkitaraman, Houston, TX (US); Frank F. Chang, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 316 days.

(21) Appl. No.: 10/667,011

(22) Filed: Sep. 19, 2003

(65) Prior Publication Data

US 2004/0099418 A1 May 27, 2004

Related U.S. Application Data

(63) Continuation-in-part of application No. 10/316,614, filed on Dec. 11, 2002, now Pat. No. 6,732,798, which is a continuation-in-part of application No. 09/797, 209, filed on Mar. 1, 2001, now Pat. No. 6,598,682.

(60) Provisional application No. 60/186,500, filed on Mar. 2, 2000, provisional application No. 60/187,900, filed on Mar. 8, 2000, provisional application No. 60/252, 754, filed on Nov. 22, 2000.

(51) Int. Cl.
*E21B 43/25* (2006.01)

(52) U.S. Cl. ..... 166/311; 166/305.1

(58) Field of Classification Search ..... 166/297, 166/311, 312, 305.1
See application file for complete search history.

(56) References Cited

U.S. PATENT DOCUMENTS

| | | | | |
|---|---|---|---|---|
| 5,131,472 | A | 7/1992 | Dees et al. | |
| 5,836,393 | A * | 11/1998 | Johnson | 166/308.1 |
| 6,302,209 | B1 * | 10/2001 | Thompson et al. | 166/305.1 |
| 6,336,506 | B2 | 1/2002 | Wesson | |
| 6,481,494 | B1 * | 11/2002 | Dusterhoft et al. | 166/51 |
| 6,494,260 | B2 * | 12/2002 | van Petegem et al. | 166/278 |
| 6,527,050 | B1 * | 3/2003 | Sask | 166/299 |

(Continued)

FOREIGN PATENT DOCUMENTS

EP 1 223 303 A1 7/2002

(Continued)

OTHER PUBLICATIONS

Behrmann, Lawrence A. and McDonald, Bryan; "Underbalance or Extreme Overbalance"; SPE Production & Facilities, vol. 14, No. 3, Aug. 1999, pp. 187-196.

(Continued)

*Primary Examiner*—Hoang Dang
(74) *Attorney, Agent, or Firm*—Trop, Prunner & Hu, P.C.; Bryan P. Galloway; Jaime A. Castano

(57) ABSTRACT

A method and apparatus for improving reservoir communication includes, in one arrangement, causing creation of tunnels in surrounding formation of a well interval, and applying treatment fluid to the tunnels. A local transient underbalance condition is created in the well interval after creation of the tunnels in the formation and application of the treatment fluids.

21 Claims, 10 Drawing Sheets

U.S. PATENT DOCUMENTS

| | | | |
|---|---|---|---|
| 2002/0020535 | A1 | 2/2002 | Johnson et al. |
| 2002/0153142 | A1 | 10/2002 | Eslinger et al. |
| 2003/0062160 | A1 | 4/2003 | Boney et al. |
| 2003/0089498 | A1 | 5/2003 | Johnson et al. |

FOREIGN PATENT DOCUMENTS

| | | | |
|---|---|---|---|
| RU | 2054525 | CI | 2/1996 |
| RU | 2084616 | C1 | 7/1997 |
| RU | 2085719 | C1 | 7/1997 |
| RU | 2123577 | C1 | 12/1998 |
| RU | 2146759 | C1 | 3/2000 |
| RU | 2162934 | C2 | 2/2001 |
| RU | 2168621 | C2 | 6/2001 |
| RU | 2171367 | C2 | 7/2001 |
| RU | 2179629 | C1 | 2/2002 |
| RU | 2180938 | C2 | 3/2002 |
| RU | 2183259 | C2 | 6/2002 |
| SU | 926252 | A1 | 5/1982 |
| SU | 1771508 | A3 | 10/1992 |
| SU | 1736223 | A1 | 11/1995 |
| SU | 1570384 | A1 | 5/1996 |
| WO | 0165060 | A1 | 9/2001 |

OTHER PUBLICATIONS

Gorodissky & Partners, Transmittal Letter with Official Action received from the Patent Office of the Russian Federation, Mar. 14, 2006, 10 pages, Moscow, Russia.

Fridlander, L. Ya., Shooting-Explosion Equipment and Application Thereof in Wellbores, 1985, pp. 32-36 and 119-126, Nedra (Mineral Resources) Publishing House, Moscow, Russia.

Grigoryan, N.G., Development of Oil and Gas Formations by Means of Shooting Perforators, 1982, pp. 22-44 and 222-232, Nedra (Mineral Resources) Publishing House, Moscow, Russia.

Sooleimanov, A.B., et al, Know-How and Equipment for Thorough Repair of Wellbores, 1987, pp. 288-297, Nedra (Mineral Resources) Publishing House, Moscow, Russia.

* cited by examiner

RESERVOIR COMMUNICATION BY CREATING A LOCAL UNDERBALANCE AND USING TREATMENT FLUID

CROSS REFERENCE TO RELATED APPLICATION

This is a continuation-in-part of U.S. Ser. No. 10/316,614, filed Dec. 11, 2002, now U.S. Pat. No. 6,732,798, which is a continuation-in-part of U.S. Ser. No. 09/797,209, filed Mar. 1, 2001, now U.S. Pat. No. 6,598,682, which claims the benefit of U.S. Provisional Application Ser. Nos. 60/186,500, filed Mar. 2, 2000; 60/187,900, filed Mar. 8, 2000; and 60/252,754, filed Nov. 22, 2000. Each of the referenced applications are hereby incorporated by reference.

TECHNICAL FIELD

The invention relates to improving reservoir communication with a wellbore.

BACKGROUND

To complete a well, one or more formation zones adjacent a wellbore are perforated to allow fluid from the formation zones to flow into the well for production to the surface or to allow injection fluids to be applied into the formation zones. A perforating gun string may be lowered into the well and the guns fired to create openings in casing and to extend perforations into the surrounding formation.

The explosive nature of the formation of perforation tunnels shatters sand grains of the formation. A layer of "shock damaged region" having a permeability lower than that of the virgin formation matrix may be formed around each perforation tunnel. The process may also generate a tunnel full of rock debris mixed in with the perforator charge debris. The extent of the damage, and the amount of loose debris in the tunnel, may be dictated by a variety of factors including formation properties, explosive charge properties, pressure conditions, fluid properties, and so forth. The shock damaged region and loose debris in the perforation tunnels may impair the productivity of production wells or the injectivity of injector wells.

One popular method of obtaining clean perforations is underbalanced perforating. The perforation is carried out with a lower wellbore pressure than the formation pressure. The pressure equalization is achieved by fluid flow from the formation and into the wellbore. This fluid flow carries some of the damaging rock particles. However, underbalance perforating may not always be effective and may be expensive and unsafe to implement in certain downhole conditions.

Fracturing of the formation to bypass the damaged and plugged perforation may be another option. However, fracturing is a relatively expensive operation. Moreover, clean, undamaged perforations are required for low fracture initiation pressure and superior zonal coverage (pre-conditions for a good fracturing job). Acidizing, another widely used method for removing perforation damage, is not effective (because of diversion) for treating a large number of perforation tunnels.

A need thus continues to exist for a method and apparatus to improve fluid communication with reservoirs in formations of a well.

SUMMARY

In general, according to one embodiment, a method for use in a wellbore includes causing creation of tunnels in surrounding formation of a well interval, and applying treatment fluid to the tunnels. A local transient underbalance condition is created in the well interval after creation of the tunnels in the formation and application of the treatment fluids.

Other or alternative features will become apparent from the following description, from the drawings and from the claims.

DETAILED DESCRIPTION

Figure 1A:
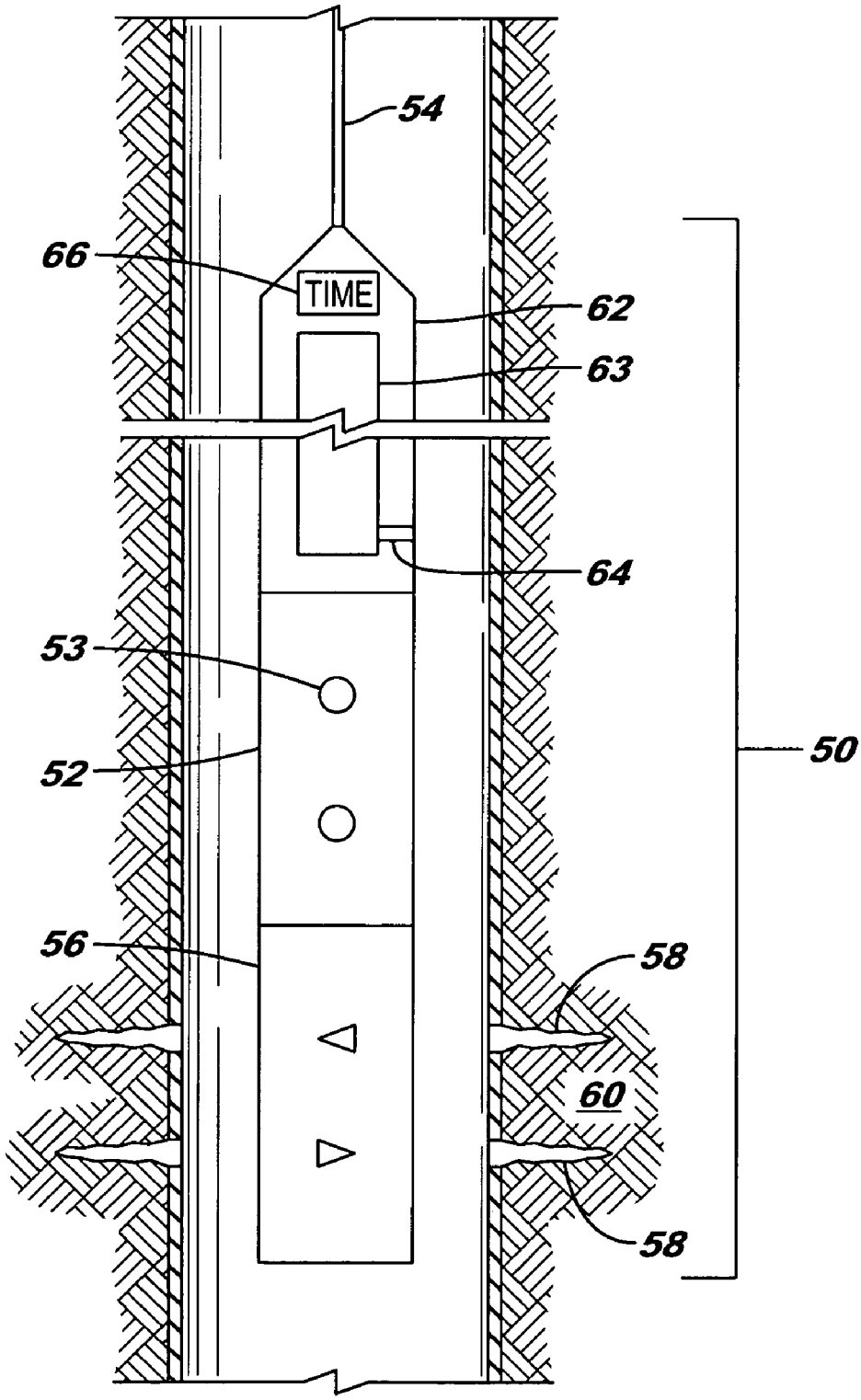
FIG. 1A illustrates an apparatus including an applicator tool for applying treatment fluid(s) and a surge tool to create a local transient underbalance condition, in accordance with an embodiment of the invention.

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and "downwardly"; "upstream" and "downstream"; "above" and "below" and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Generally, methods and apparatus are provided to treat perforation damage and to remove debris from tunnels created by perforation into a well formation. There are several potential mechanisms of damage to formation productivity and injectivity due to perforation. One may be the presence of a layer of low permeability sand grains (grains that are fractured by the shaped charge) after perforation. As the produced fluid from the formation may have to pass through this lower permeability zone, a higher than expected pressure drop may occur resulting in lower productivity. Underbalance perforating is one way of reducing this type of damage. However, in many cases, insufficient underbalance may result in only partial alleviation of the damage. The second major type of damage may arise from loose perforation-generated rock and charge debris that fills the perforation tunnels. Not all the particles may be removed into the wellbore during underbalance perforation, and these in turn may cause declines in productivity and injectivity (for example, during gravel packing, injection, and so forth). Yet another type of damage occurs from partial opening of perforations. Dissimilar grain size distribution can cause some of these perforations to be plugged (due to bridging, at the casing/cement portion of the perforation tunnel), which may lead to loss of productivity and injectivity.

To remedy these types of damage, two forces acting simultaneously may be needed, one to free the particles from forces that hold them in place and another to transport them. The fractured sand grains in the perforation tunnel walls may be held in place by rock cementation, whereas the loose rock and sand particles and charge debris in the tunnel may be held in place by weak electrostatic forces. Sufficient fluid flow velocity is required to transport the particles into the wellbore.

According to some embodiments of the invention, a combination of events are provided to enhance the treatment of damage and removal of debris: (1) application of treatment fluid(s) into tunnels; and (2) creation of a local transient low pressure condition (local transient underbalance) in a wellbore interval. Examples of treatment fluids that are applied include acid, chelant, solvent, surfactant, brine, oil, and so forth. The application of the treatment fluids causes at least one of the following to be performed: (1) remove surface tension within perforation tunnels, (2) reduce viscosity in heavy oil conditions, (3) enhance transport of debris such as sand, (4) clean out residual skin in a perforation tunnel, (5) achieve near-wellbore stimulation, (6) perform dynamic diversion of acid such that the amount of acid injected into each perforation tunnel is substantially the same, and (7) dissolve some minerals. Basically, application of the treatment fluids changes the chemistry of fluids in a target wellbore interval to perform at least one of the above tasks.

The application of treatment fluids to perforation tunnels is done in an overbalance condition (wellbore pressure is greater than formation pressure). A subsequent fluid surge creates the dynamic underbalance condition. Following the dynamic underbalance condition, the target wellbore interval is set to any of an underbalance condition, overbalance condition, and balanced condition. Thus, according to some embodiments, a sequence of some combination of overbalance, underbalance, and balanced conditions is generated in the target wellbore interval, such as overbalance-underbalance-overbalance, overbalance-underbalance-underbalance, overbalance-underbalance-balanced, underbalance-overbalance-underbalance, and so forth. This sequence of different pressure conditions occurs within a short period of time, such as in a time period that is less than or equal to about 10 seconds.

Application of treatment fluids is performed by use of an applicator tool, described further below. The local transient underbalance condition is created by use of a chamber containing a relatively low fluid pressure. For example, the chamber is a sealed chamber containing a gas or other fluid at a lower pressure than the surrounding wellbore environment. As a result, when the chamber is opened, a sudden surge of fluid flows into the lower pressure chamber to create the local low pressure condition in a wellbore region in communication with the chamber after the chamber is opened.

In some implementations, the chamber is a closed chamber that is defined in part by a closure member located below the surface of the well. In other words, the closed chamber does not extend all the way to the well surface. For example, the closure member may be a valve located downhole. Alternatively, the closure member includes a sealed container having ports that include elements that can be shattered by some mechanism (such as by the use of explosive or some other mechanism). The closure member may be other types of devices in other embodiments.

In one embodiment, a sealed atmospheric container is lowered into the wellbore after a formation has been perforated. After production is started, openings are created (such as by use of explosives, valves, or other mechanisms) in the housing of the container to generate a sudden underbalance condition or fluid surge to remove the damaged sand grains around the perforation tunnels and to remove loose debris.

FIG. 1A shows an apparatus 50 according to one embodiment, which includes a surge tool 52 to create a local transient underbalance condition. The surge tool 52 includes one or more ports 53 that are selectively openable to enable communication with an inner, lower pressure chamber inside the surge tool 52. The ports 53 can be actuated opened by use of a valve, an explosive, or some other mechanisms. In conventional global cleanup operations in which the entire well is treated, high permeability sections are preferentially treated, which may cause other sections to be under-treated. By using local fluid surges to perform the cleanup, more focused treatment can be accomplished.

Various mechanisms can be used to provide the low pressure in the chamber of the surge tool 52. For example, a tubing or control line can be used to communication the low pressure. Alternatively, the low pressure is carried in a sealed container into the wellbore.

According to another embodiment, an underbalance condition may be created by using a choke line and a kill line that are part of subsea well equipment in subsea wells. In this other embodiment, the choke line, which extends from the subsea well equipment to the sea surface, may be filled with a low density fluid, while the kill line, which also extends to the sea surface, may be filled with a heavy wellbore fluid. Once the tool string is run into the wellbore, a blow-out preventer (BOP), which is part of the subsea well equipment, may be closed, followed by opening of the choke line below the BOP and the closing of the kill line below the BOP. Opening of the choke line and closing of the kill line causes a reduction in the hydrostatic head in the wellbore to create an underbalance condition.

In yet another embodiment, a chamber within the gun 56 can be used as a sink for wellbore fluids to generate the underbalance condition. Following charge combustion, hot detonation gas fills the internal chamber of the gun. If the resultant detonation gas pressure is less than the wellbore pressure, then the cooler wellbore fluids are sucked into the gun housing. The rapid acceleration through perforation ports in the gun housing breaks the fluid up into droplets and results in rapid cooling of the gas. Hence, rapid gun pressure loss and even more rapid wellbore fluid drainage occurs, which generates a drop in the wellbore pressure. The drop in wellbore pressure creates an underbalance condition.

The apparatus 50 is run to a desired depth on a carrier line 54 (e.g., coiled tubing, wireline, slickline, etc.). The apparatus 50 includes a perforating gun 56 that is activatable to create perforation tunnels 58 in formation 60 surrounding a wellbore interval. The perforating gun 56 can be activated by various mechanisms, such as by a signal communicated over an electrical conductor, a fiber optic line, a hydraulic control line, or other type of conduit.

The apparatus 50 further includes an applicator tool 62 for applying a treatment fluid (e.g., acid, chelant, solvent, surfactant, brine, oil, enzyme and so forth, or any combination of the above) into the wellbore interval shown in FIG. 1, which in turn flows into the perforation tunnels 58. The treatment fluid applied can be a matrix treatment fluid. The applicator tool 62 may include a pressurized chamber 63 containing the treatment fluid. Upon opening of a port 64, the pressurized fluid in the chamber 63 is communicated into the surrounding wellbore interval. Alternatively, the applicator tool 62 is in communication with a fluid conduit that extends to the well surface. The treatment fluid is applied down the fluid conduit to the applicator tool 62 and through the port 64 to fill the surrounding wellbore interval. The fluid conduit for the treatment fluid can be extended through the carrier line 54. Alternatively, fluid conduit may run external to the carrier line 54.

In yet another embodiment, the applicator tool 62 does not need to apply pressurized fluid. Another device is provided as part of the apparatus 50 to create an overbalance condition, such as a transient overbalance condition (where the wellbore interval pressure is greater than the formation pressure). The overbalance condition causes the treatment fluid to flow into the perforation tunnels 58. In one embodiment, the other device for creating the overbalance condition is the perforating gun 56.

The applicator tool 62 can be designed to provide more than one type of treatment fluid to the surrounding wellbore interval. In one example implementation, the applicator tool 62 can include multiple chambers for storing multiple different types of treatment fluids. Alternatively, multiple fluid conduits are provided to apply multiple types of treatment fluids.

The treatment fluid that can be applied by the applicator tool 62 of FIG. 1 can include brine to reduce surface tension within the perforation tunnels 58. Application of the brine increases rock brine saturation, which improves perforation tunnel cleanup when the subsequent surge is performed by creating the local transient underbalance condition.

As another example, the treatment fluid includes surfactant, which is applied into the perforation tunnels 58 to enhance the transport of debris (such as sand) during the transient underbalance surge operation. Surfactant tends to reduce surface tension between sand grain and local fluids (in a reservoir) so that the sand grains can more easily come out of the perforation tunnels 58.

Figure 2:
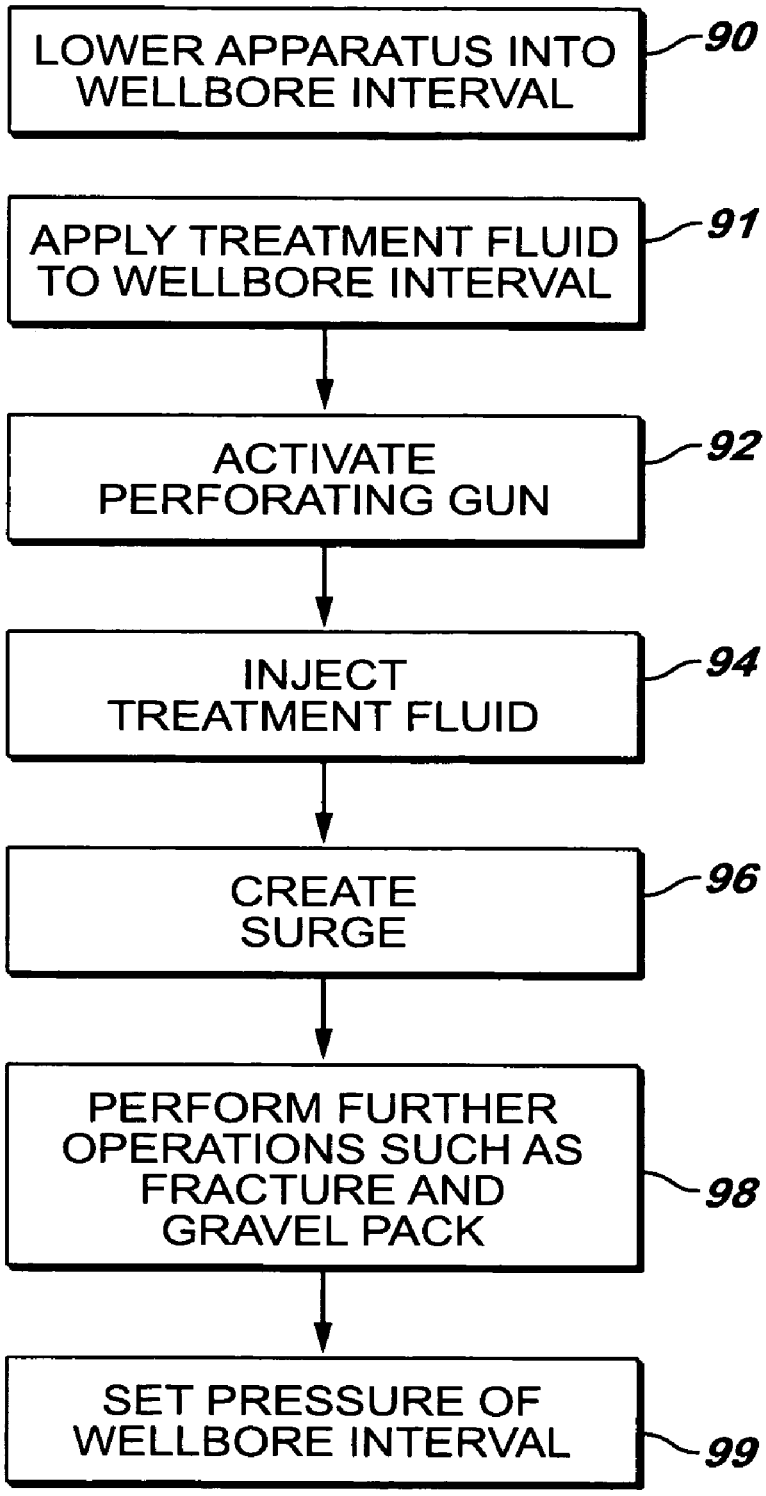
FIG. 2 is a flow diagram of a process according to an embodiment of the invention.

In operation, as shown in FIG. 2, the apparatus 50 is lowered (at 90) to a wellbore interval. Treatment fluid(s) is than applied (at 91) by opening the port 64 of the applicator tool 62. In some cases, the application of the treatment fluid(s) is controlled according to a time release mechanism 66. The rate of dispensing the treatment fluid(s) is selected to achieve optimal performance. In other embodiments, the time release mechanism 66 can be omitted. The perforating gun 56 is then activated (at 92) to fire shaped charges in the perforating gun to extend perforation tunnels 58 into the surrounding formation 60.

Upon activation of the perforating gun 56, a transient overbalance condition is created. The time period of such an overbalance condition can be relatively short (e.g., on the order of milliseconds). This overbalance conditions causes the injection (at 94) of treatment fluid into the perforation tunnels 58. The timing of application of the treatment fluid(s) can be selected to coincide substantially with the activation of the perforating gun 66 such that the treatment fluid(s) can be flowed into the perforation tunnels 58 in the presence of the transient overbalance condition.

To achieve a longer period of overbalance, a tubing conveyed perforating gun can be employed such that pressurized fluid is applied through tubing to create the overbalance condition in the desired interval. An overbalance of thousands of pounds per square inch (psi) can typically be achieved by tubing conveyed perforating guns.

In some cases, such as with carbonate reservoirs, it may be desirable to apply acid into the perforation tunnels 58. Conventionally, diversion of such acid occurs such that the acid flows unequally into the various perforation tunnels 58, due to the fact that the acid tends to flow more to paths of least resistance. However, by timing the application substantially simultaneously with the transient overbalance created due to perforating, a more equal distribution of acid into the perforation tunnels 58 can be achieved. The more uniform distribution of acid in the perforation tunnels 58 is achieved by application of the acid in a relatively short period of time (e.g., milliseconds). This process is referred to a dynamic diversion. The injection of acid into each perforation tunnel 58 provides near-wellbore stimulation, which acts to enhance a subsequent cleanup operation.

After application of the treatment fluid(s), the surge tool 52 is activated (96) to create the local transient underbalance condition. This causes a flow of fluid and debris out of the perforation tunnels 58 into the wellbore such that cleanup of the perforation tunnels 58 can be achieved. Further operations, such as fracturing and/or gravel packing, can then be performed (at 98). Prior to, at the same time, or after the further operations (98), the wellbore interval can be set (at 99) to any one of an overbalance condition, underbalance condition, or balanced condition.

Figure 1B:
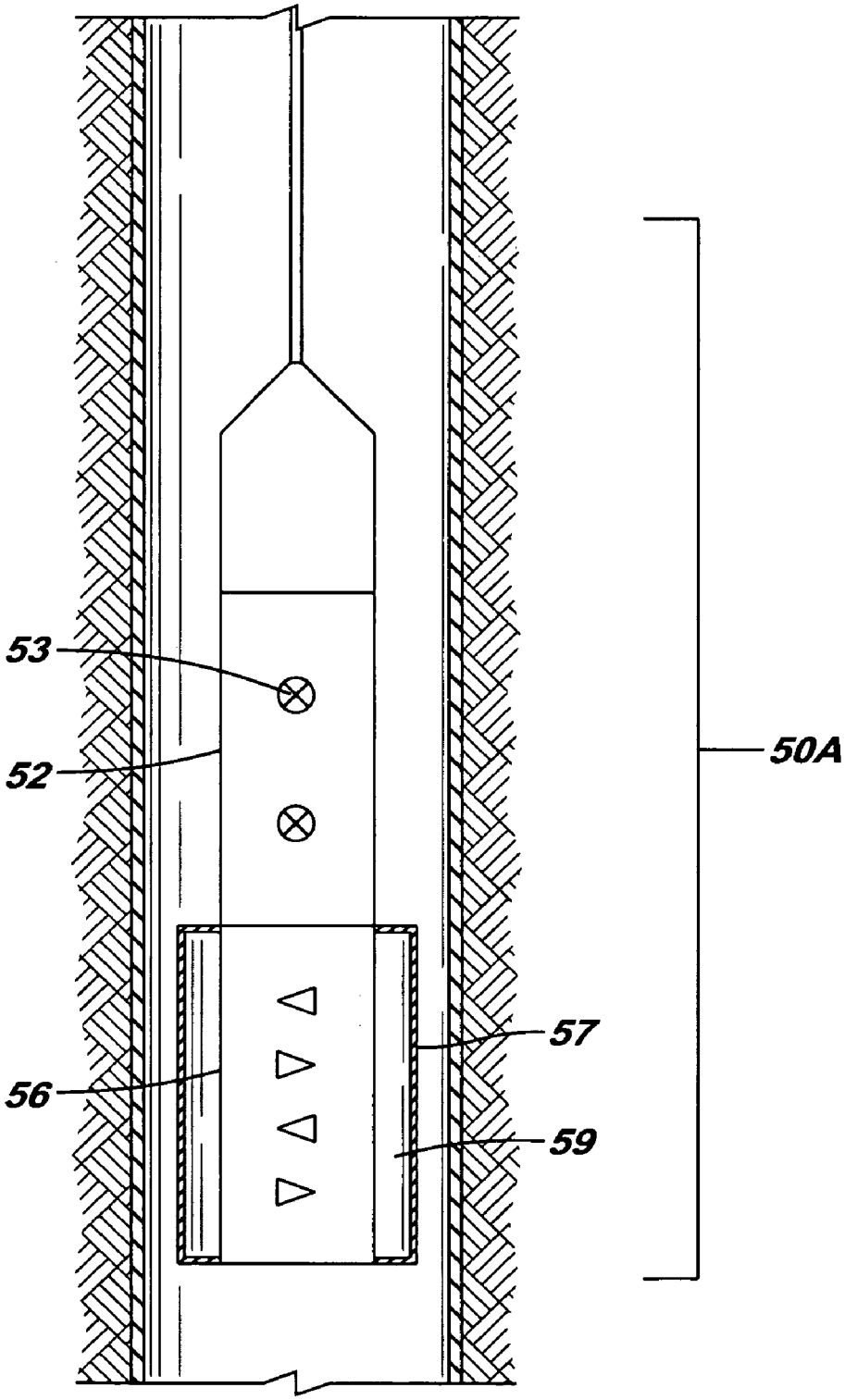
FIG. 1B illustrates an apparatus according to another embodiment for applying treatment fluid(s) into perforation tunnels.

FIG. 1B illustrates another embodiment of an apparatus 50A. In this embodiment, instead of the applicator device 62 of FIG. 1A, the apparatus 50A includes an annular shell 57 provided around the perforating gun 56. The annular shell 57 includes an annular chamber 59 in which a treatment fluid can be provided.

In operation, firing of the perforating gun 56 causes the shell 57 to be shattered. The treatment fluid in the chamber 59 is carried by the gun gases into the perforating tunnels. Afterwards, the surge tool 52 is activated to create the dynamic underbalance.

In certain types of reservoirs, such as carbonate reservoirs, natural fractures are present. In such reservoirs, oriented perforating is performed such that the perforation tunnels 58 are oriented to be perpendicular to the fractures. Usually, the perforation operation causes crust material to be created that closes or reduces communication between the perforation tunnels 58 and the fractures.

The apparatus 50 or 50A can also be used to perform cleanup of the paths between fractures and perforation tunnels. Treatment fluid(s), such as brine, surfactant, solvent, and so forth, is applied to reduce or remove surface tension. When a subsequent surge is performed by the surge tool 52, the crust material that blocked communication between the fractures and perforation tunnels 58 can be removed.

A benefit of performing cleanup of perforation tunnels 58 according to some embodiments of the invention is that enhanced productivity of hydrocarbons can be achieved due to the enhanced communications through the perforation tunnels 58. The enhanced productivity may reduce the need for a subsequent fracturing operation, which reduces the costs of well operation. Even if fracturing has to be performed, the enhanced communications in the perforation tunnels 58 may reduce the initial fracturing pressure required to start the fracture operation. This in turn allows the well operator to avoid having to provide large pressure sources at the well surface, which often present a safety hazard.

The fracturing operation, if needed, is performed as one of the further operations indicated as 98 in FIG. 2. The further operations 98 are performed after the surge operation to perform cleanup according to some embodiments. Another operation that can be performed after the surge operation is a gravel pack operation, in which gravel pack slurry is pumped to the wellbore interval after the operations indicated as 90, 91, 92, 94, and 96 in FIG. 2. Gravel packing is performed for sand control to prevent the production of sand during production flow. Gravel packing may be performed after the fracture operation.

Embodiments of the invention can also be applied to screen-less completions. Usually, to perform sand control, a screen (e.g., wire mesh or other structure with openings to allow fluid to flow through but to block sand flow) is provided in the vicinity of the perforations 58. However, in other implementations, screens can be avoided. With screen-less completions, flowback preventers are placed in the perforation tunnels 58. The apparatus 50 is used to provide better performing perforation tunnels 58 prior to the installation of the flowback preventers. Other materials can also be placed into the perforation tunnels to prevent flowback of solids into the perforation tunnels 58 from the wellbore.

As noted above, a sequence of different pressure conditions are set in the wellbore interval adjacent the formation in which perforation tunnels 58 are created. The pressure conditions include overbalance conditions, underbalance conditions, and balanced conditions. Any sequence of such conditions can be created in the wellbore interval. The examples discussed above refers to first creating an overbalance condition to allow the injection of treatment fluids into perforation tunnels, followed by a transient underbalance condition to clean out the perforation tunnels. After the transient underbalance, another pressure condition is later set in the wellbore interval. The following charts in FIGS. 9–13 illustrate different sequences of pressure conditions that can be set in the wellbore interval.

Figure 9:
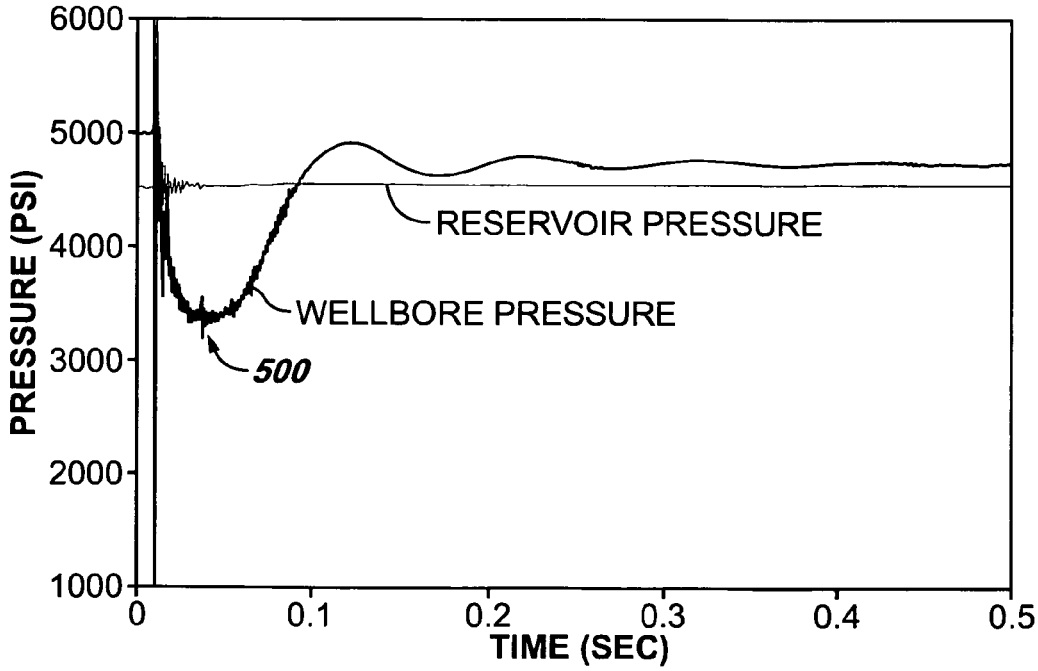
FIGS. 9–13 are timing diagrams of pressure over time.

FIG. 9 shows a chart to illustrate wellbore pressure and reservoir pressure over time (from 0 to 0.5 seconds). The target wellbore interval starts with an overbalance condition (where the wellbore pressure is greater than the reservoir pressure). A dynamic underbalance is then created (where the wellbore pressure is less than the reservoir pressure), indicated as 500. As shown in the example of FIG. 9, the dynamic underbalance condition extends a period that is less than 0.1 seconds in duration. Later, after the dynamic underbalance (500), the wellbore interval is set at an overbalance condition.

Figure 10:
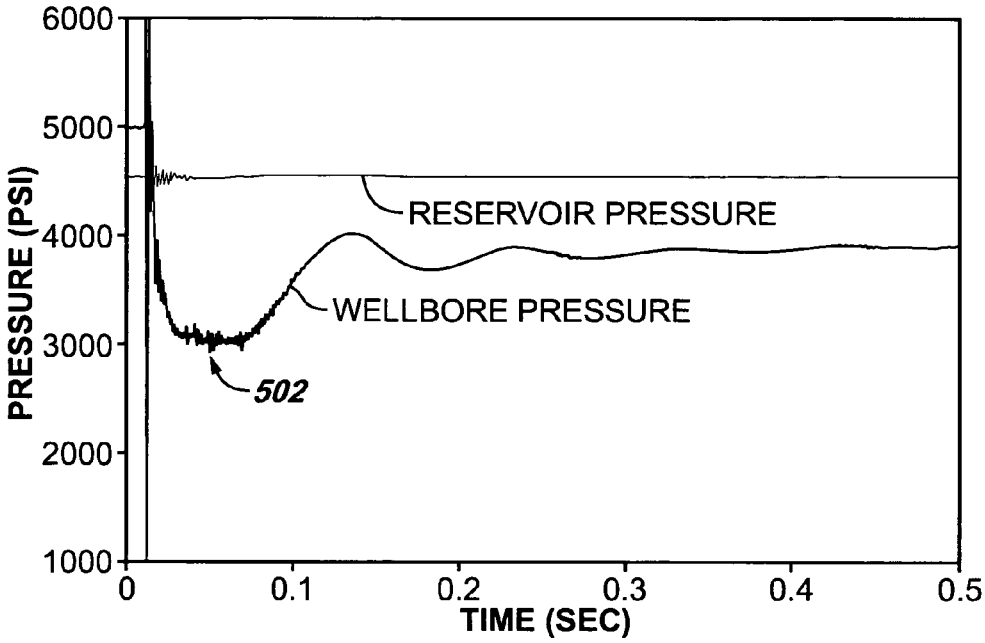
Figure 11:
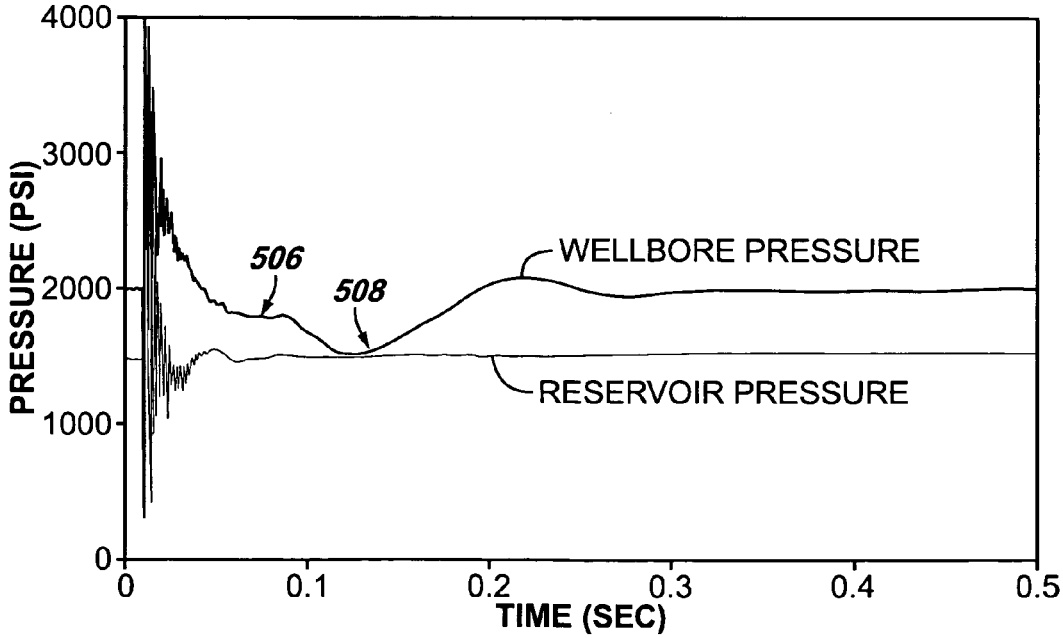

FIG. 10 shows another sequence, in which the wellbore interval starts in the overbalance condition, with a transient underbalance (at 502) created shortly after the initial overbalance condition. Later, an underbalance condition is maintained. FIG. 11 shows another sequence, in which the wellbore interval starts in an overbalance condition, with a transient pressure dip (506) created in which the wellbore pressure is reduced but stays above the reservoir pressure. Next, the wellbore pressure is reduced further such that it is balanced (at 508) with respect to the reservoir pressure. Later, the wellbore pressure is set at a pressure to provide an overbalance condition.

Figure 12:
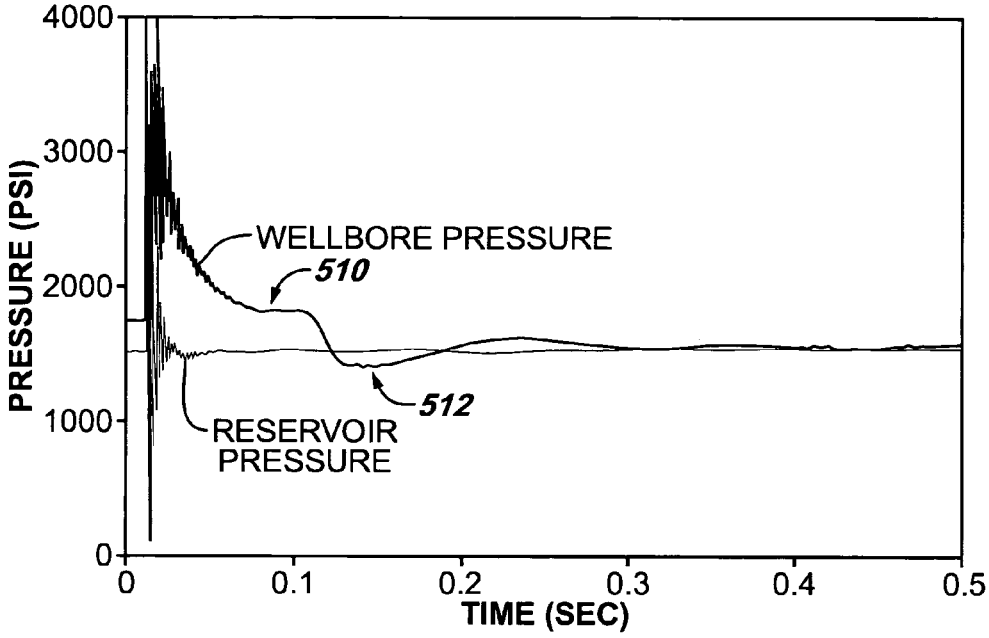

FIG. 12 shows another chart in which the wellbore pressure starts overbalanced, and is followed by a dip in the wellbore pressure to first create a transient condition in which the wellbore pressure remains overbalanced (indicated as 510). Next, another transient condition is created in which the wellbore pressure is dropped further such that an underbalance condition is created (indicated as 512). Later, the wellbore pressure is elevated to provide an overbalance and finally the wellbore pressure and reservoir pressure are balanced.

Figure 13:
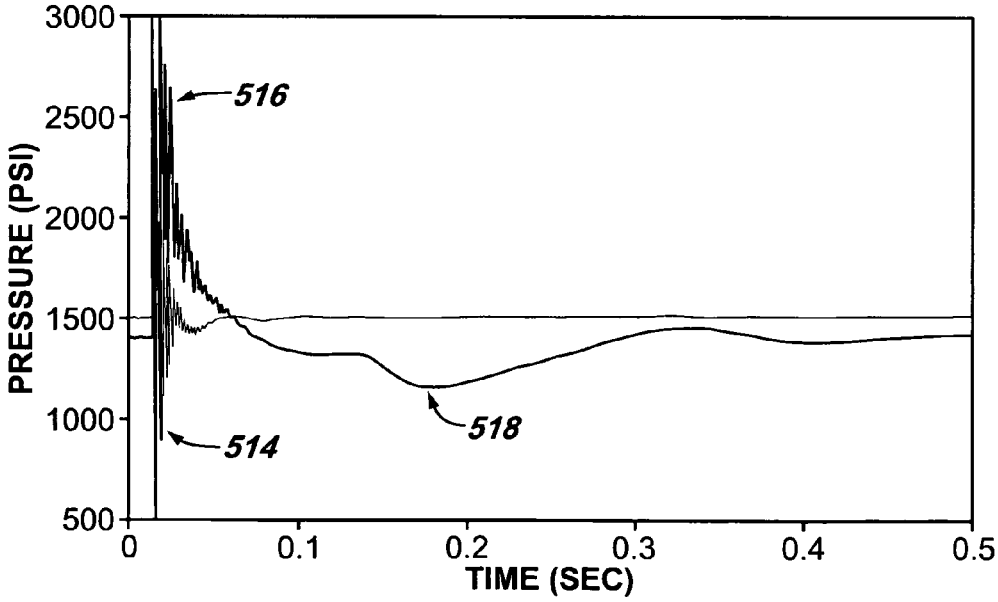

FIG. 13 shows another example sequence, in which the wellbore interval starts underbalanced (514), followed by a transient overbalance (516). After the transient overbalance, a transient underbalance (518) is created. Later, the wellbore interval is kept at the underbalance condition.

The charts in FIGS. 9–13 are illustrative examples, as many other sequences of pressure conditions can be set in the wellbore interval, according to the needs and desires of the well operator.

The following discusses various tools that can be used to create the surge discussed above for generating the local transient underbalance condition. The tools discussed below can be used to replace either the surge tool 52 or the combination of the surge tool 52 and the perforating gun 56 of FIG. 1.

Figure 3A:
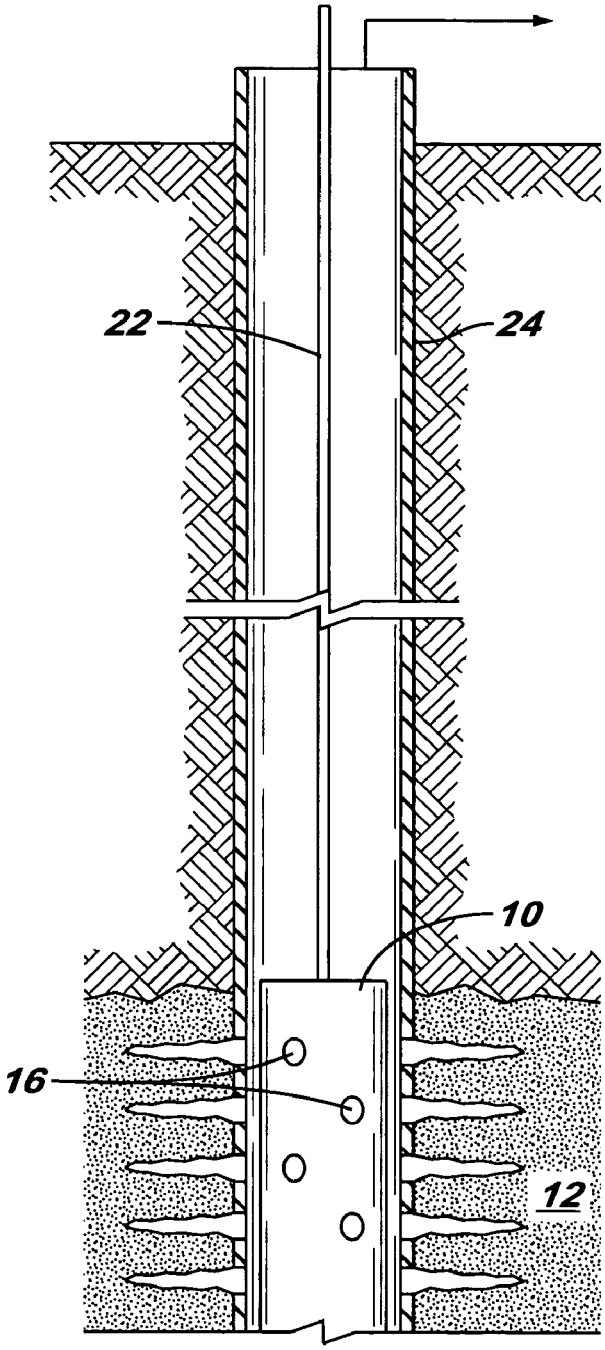
FIGS. 3A and 3B illustrate a tool string according an embodiment for creating an underbalance condition in a wellbore.

Referring to FIG. 3A, a tool string having a sealed atmospheric container 10 (or container having an inner pressure that is lower than an expected pressure in the wellbore in the interval of the formation 12) is lowered into a wellbore (which is lined with casing 24) and placed adjacent a perforated formation 12 to be treated. The tool string is lowered on a carrier line 22 (e.g., wireline, slickline, coiled tubing, etc.). The container 10 includes a chamber that is filled with a gas (e.g., air, nitrogen) or other fluid. The container 10 has a sufficient length to treat the entire formation 12 and has multiple ports 16 that can be opened up using explosives.

Figure 3B:
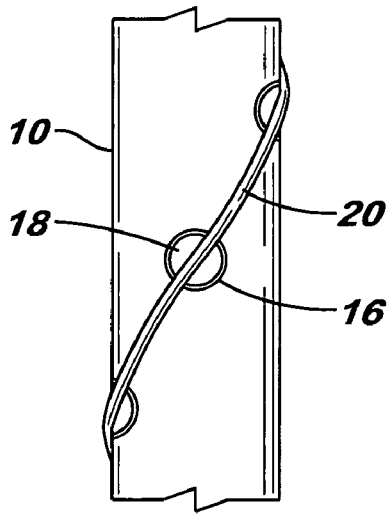

As shown in FIG. 3B, the ports 16 may include openings that are plugged with sealing elements 18 (e.g., elastomer elements, ceramic covers, etc.). An explosive, such as a detonating cord 20, is placed in the proximity of each of the ports 16. Activation of the detonating cord 20 causes the sealing elements 18 to shatter or break away from corresponding ports 16. In another embodiment, the ports 16 may include recesses, which are thinned regions in the housing of the container 10. The thinned regions allow easier penetration by explosive forces.

In one embodiment, while the well is producing (after perforations in the formation 12 have been formed), the atmospheric chamber in the container 10 is explosively opened to the wellbore. This technique can be used with or without a perforating gun. When used with a gun, the atmospheric container allows the application of a dynamic underbalance even if the wellbore fluid is in overbalance just prior to perforating. The atmospheric container 10 may also be used after perforation operations have been performed. In this latter arrangement, production is established from the formation, with the ports 16 of the atmospheric container 10 explosively opened to create a sudden underbalance condition.

The explosively actuated container 10 in accordance with one embodiment includes air (or some other suitable gas or fluid) inside. The dimensions of the chamber 10 are such that it can be lowered into a completed well either by wireline, coiled tubing, or other mechanisms. The wall thickness of the chamber is designed to withstand the downhole wellbore pressures and temperatures. The length of the chamber is determined by the thickness of perforated formation being treated. Multiple ports 16 may be present along the wall of the chamber 10. Explosives are placed inside the atmospheric container in the proximity of the ports. The explosives may include a detonating cord (such as 20 in FIG. 3B) or even shaped charges.

In one arrangement, the tool string including the container 10 is lowered into the wellbore and placed adjacent the perforated formation 12. In this arrangement, the formation 12 has already been perforated, and the atmospheric chamber 10 is used as a surge generating device to generate a sudden underbalance condition. Treatment fluid(s) is injected by an applicator tool (such as the applicator tool 52 of FIG. 1) prior to opening of the atmospheric chamber 10.

After the atmospheric container 10 is lowered and placed adjacent the perforated formation 12, the formation 12 is flowed by opening a production valve at the surface. While the formation is flowing, the explosives are set off inside the atmospheric container, opening the ports of the container 10 to the wellbore pressure. The shock wave generated by the explosives may provide the force for freeing the particles. The sudden drop in pressure inside the wellbore may cause the fluid from the formation to rush into the empty space left in the wellbore by the atmospheric container 10. This fluid carries the mobilized particles into the wellbore, leaving clean formation tunnels. The chamber may be dropped into the well or pulled to the surface.

The characteristics (including the timing relative to perforating) of the fluid surge can be based on characteristics (e.g., wellbore diameter, formation pressure, hydrostatic pressure, formation permeability, etc.) of the wellbore section in which the local low pressure condition is to be generated. Generally, different types of wellbores having different characteristics. In addition to varying timing of the surge relative to the perforation, the volume of the low pressure chamber and the rate of fluid flow into the chamber can be controlled. The surge to be created is also dependent upon the type of treatment fluid(s) selected for injection into the perforation tunnels.

Figure 4:
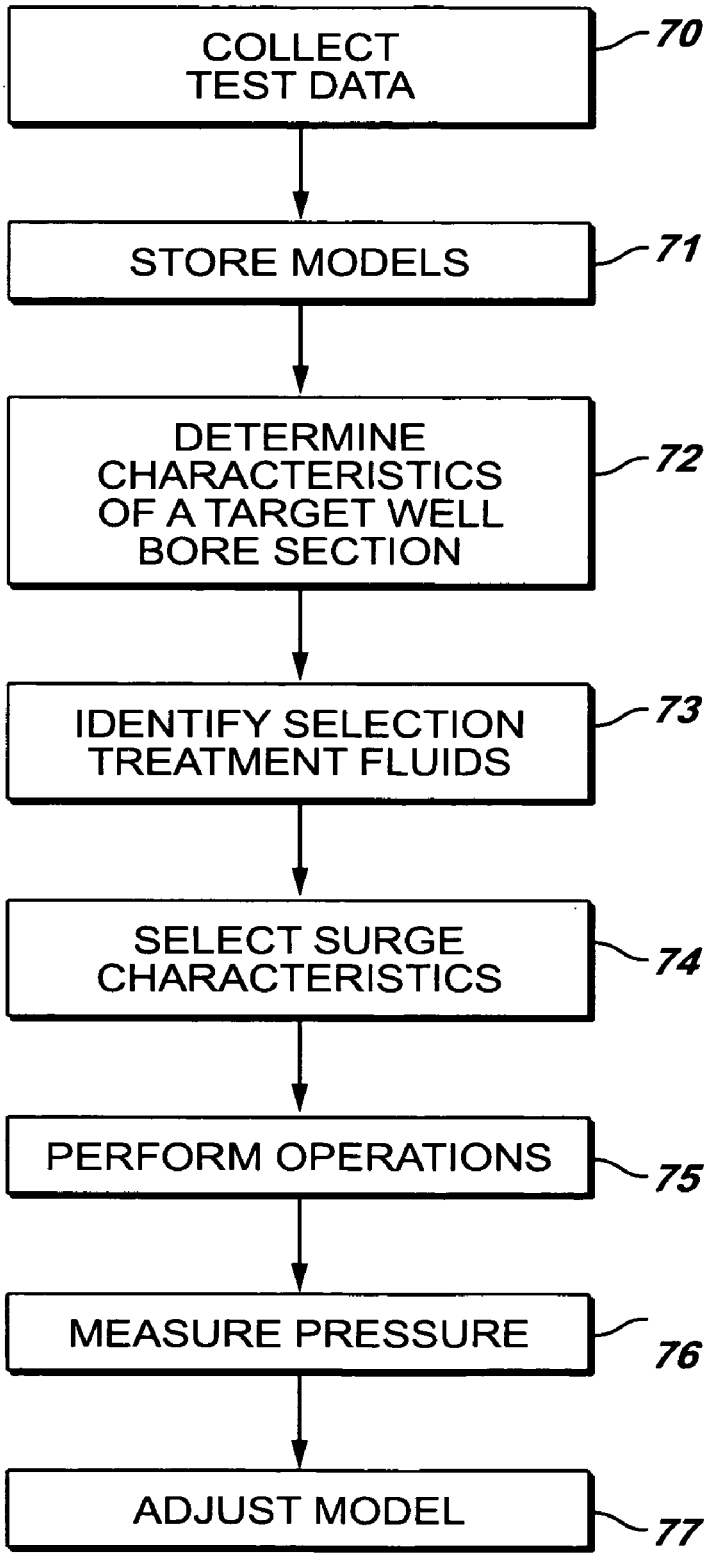
FIG. 4 is a flow diagram of a process of selecting characteristics of a fluid flow surge based on wellbore characteristics and selected treatment fluid(s).

Referring to FIG. 4, tests can be performed on wells of different characteristics, with the tests involving creation of pressure surges of varying characteristics to test their effectiveness. The test data is collected (at 70), and the optimum surge characteristics for a given type of well are stored (at 71) in models for later access.

When a target well in which a local surge operation is identified, the characteristics of the well are determined (at 73) and matched to one of the stored models. Also, the selected treatment fluid(s) is identified (at 74). Based on the model and the selected treatment fluid(s), the surge characteristics are selected (at 75), and the operations involving the application of the selected treatment fluid(s) and surge are performed (at 76). As part of the operations, the pressure condition and other well conditions in the wellbore section resulting from the surge can be measured (at 76), and the model can be adjusted (at 77) if necessary for future use.

Figure 5:
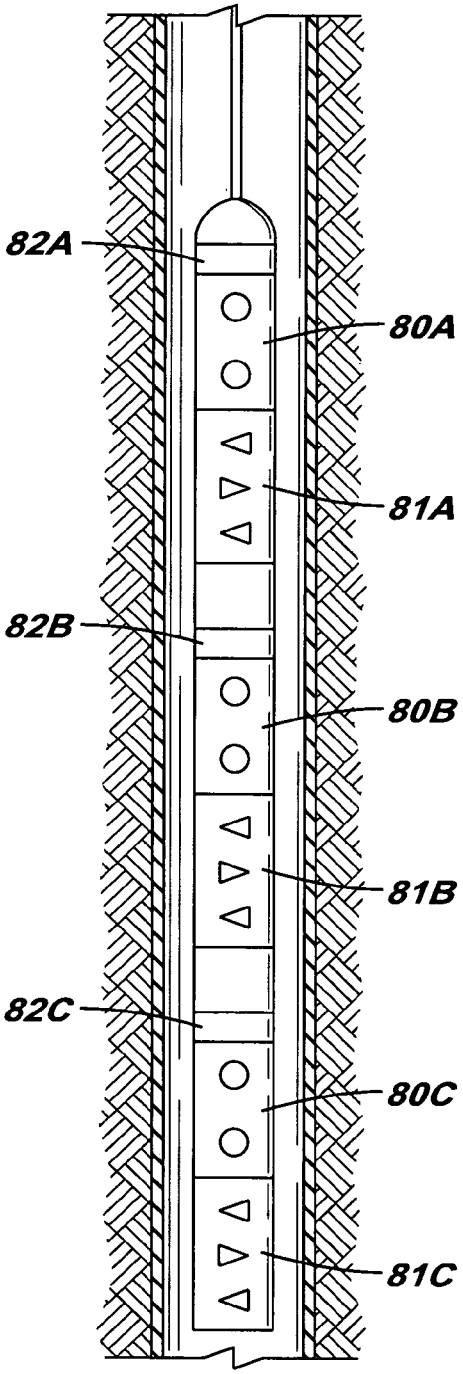
FIG. 5 illustrates a string having plural sections, each section including a perforating gun, an applicator tool to apply treatment fluid(s), and a surge tool to create an underbalance condition or surge.

Even though the embodiment of FIG. 1 includes an apparatus to perform a single perforating operation followed by a single application of treatment fluid(s) and surge operation, other embodiments can involve multiple perforating, treatment fluid application, and surge operations. For example, referring to FIG. 5, a string includes three sections that are activated at different times. Other examples can involve a lower number or greater number of sections. The string includes surge tools 80A, 80B, 80C, corresponding applicator tools 82A, 82B, 82C (for application of treatment fluid), and corresponding perforating guns 81A, 81B, 81C. The first section (80A, 81A, 82A) can be activated first, followed sequentially by activation of the second (80B, 81B, 82B) and third (80C, 81C, 82C) sections. The delay between activation of the different sections can be set to predetermined time delays. As discussed here, activation of a section can refer to activating the perforating gun 81 followed by injection of treatment fluid(s) from the applicator tool 82, then followed by opening the surge tool 80 to generate a local transient underbalance condition.

Figure 6:
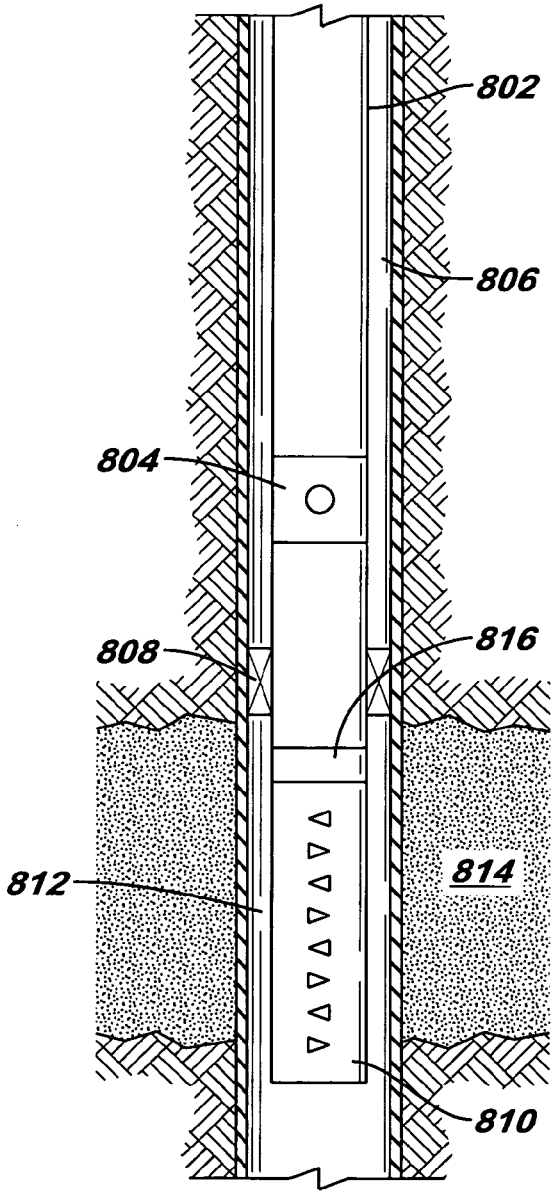
FIG. 6 illustrates yet another embodiment of a tool string including a valve that is actuatable between open and closed positions to create desired pressure conditions during a surge operation after perforating and application of treatment fluid(s).

Referring to FIG. 6, in an alternative embodiment, a tool having an applicator tool 816 (for applying treatment fluid) and a valve 804 (e.g., a ball valve) is used. The ball valve 804 is part of a string that also includes a tubing or other conduit 802, a packer 808, and a perforating gun 810.

When run-in, the valve 804 is in the closed position. Once the string is lowered to the proper position, and after perforation and application of treatment fluid(s), the packer 808 is set to isolate an annulus region 806 above the packer 808 from a rathole region 812 below the packer 808. The internal pressure of the tubing 802 is bled to a lower pressure, such as atmospheric pressure. Because the valve 804 is closed, the formation is isolated during perforation. After the gun 810 is fired and application of treatment fluid is performed, the valve 804 is opened, which causes a surge of fluid from the rathole 812 into the inner bore of the tubing 802. The surge causes generation of a local transient underbalance condition.

Figure 7:
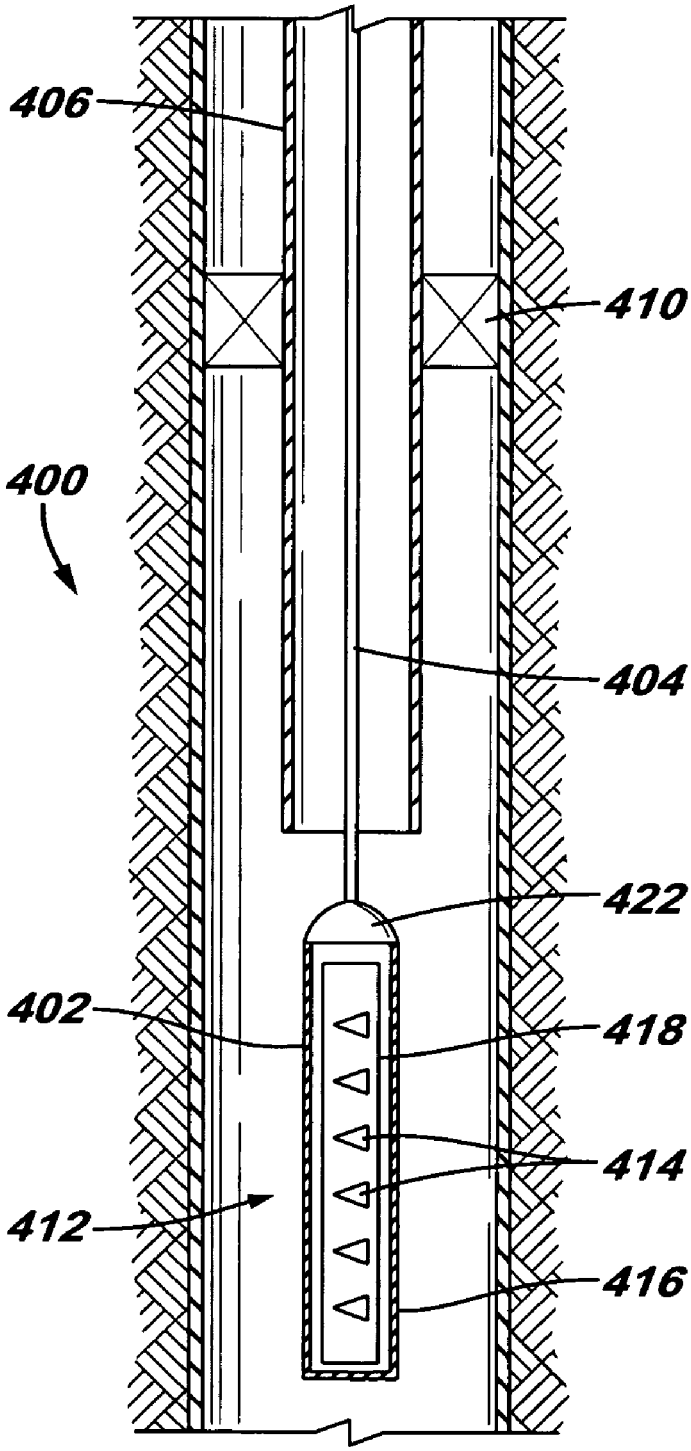
FIGS. 7 and 8 illustrate a perforating gun string positioned in a wellbore.

Referring to FIG. 7, according to yet another embodiment, a tool string 400 includes an applicator tool 422 (for applying treatment fluid) and a perforating gun 402, all carried on a carrier line 404, which can be a slickline, a wireline, or coiled tubing. In one embodiment, the perforating gun 402 is a hollow carrier gun having shaped charges 414 inside a chamber 418 of a sealed housing 416. In the arrangement of FIG. 7, the perforating gun 402 is lowered through a tubing 406. A packer 410 is provided around the tubing 406 to isolate the interval 412 in which the perforating gun 402 is to be shot (referred to as the "perforating interval 412"). A pressure $P_W$ is present in the perforating interval 412.

Figure 8:
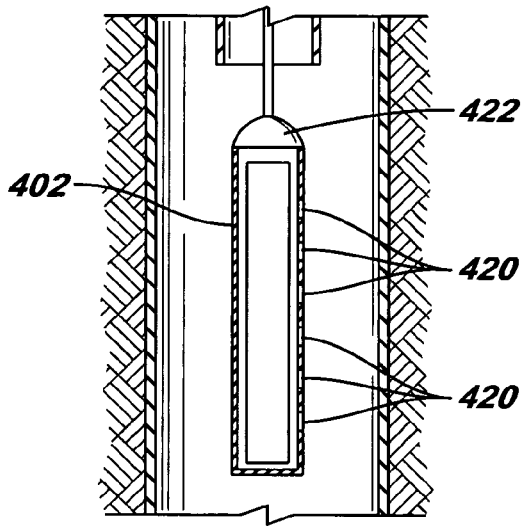

Referring to FIG. 8, during detonation of the shaped charges 414, perforating ports 420 are formed as a result of perforating jets produced by the shaped charges 414. During combustion of the shaped charges 414, hot detonation gas fills the internal chamber 418 of the gun 416. If the resultant detonation gas pressure, $P_G$, is less than the wellbore pressure, $P_W$, by a given amount, then the cooler wellbore fluids will be sucked into the chamber 418 of the gun 402. The rapid acceleration of well fluids through the perforation ports 420 will break the fluid up into droplets, which results in rapid cooling of the gas within the chamber 418. The resultant rapid gun pressure loss and even more rapid wellbore fluid drainage into the chamber 418 causes the wellbore pressure $P_W$ to be reduced. Depending on the absolute pressures, this pressure drop can be sufficient to generate a relatively large underbalance condition (e.g., greater than 2000 psi), even in a well that starts with a substantial overbalance (e.g., about 500 psi). The underbalance condition is dependent upon the level of the detonation gas pressure $P_G$, as compared to the wellbore pressure, $P_W$.

When a perforating gun is fired, the detonation gas product of the combustion process is substantially hotter than the wellbore fluid. If cold wellbore fluids that are sucked into the gun produce rapid cooling of the hot gas, then the gas volume will shrink relatively rapidly, which reduces the pressure to encourage even more wellbore fluids to be sucked into the gun. The gas cooling can occur over a period of a few milliseconds, in one example. Draining wellbore liquids (which have small compressibility) out of the perforating interval 412 can drop the wellbore pressure, $P_W$, by a relatively large amount (several thousands of psi). Between the time the perforating gun 402 is fired and the underbalance condition is created, the applicator tool 422 can be activated to cause injection of treatment fluid(s).

In accordance with some embodiments, various parameters are controlled to achieve the desired difference in values between the two pressures $P_W$ and $P_G$. For example, the level of the detonation gas pressure, $P_G$, can be adjusted by the explosive loading or by adjusting the volume of the chamber 418. The level of wellbore pressure, $P_W$, can be adjusted by pumping up the entire well or an isolated section of the well, or by dynamically increasing the wellbore pressure on a local level.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A method for use in a wellbore, comprising:

causing creation of tunnels in surrounding formation of a well interval;

applying treatment fluid to the tunnels; and creating a local transient underbalance condition in the well interval after creation of the tunnels in the formation and application of the treatment fluids, wherein creating the local transient underbalance condition in the well interval is accomplished by using at least one of:

opening at least one port to a sealed container containing a low pressure, the sealed container lowered into the wellbore by a carrier line;

communicating the wellbore interval with a choke line containing low density fluid, the choke line being associated with subsea well equipment; and providing a chamber of a perforating gun as a sink for fluids from the wellbore interval.

2. The method of claim 1, wherein creating the local transient underbalance condition causes a surge of fluid flow out of the tunnels to clean the tunnels.

3. The method of claim 1, wherein causing the creation of tunnels comprises firing a perforating gun.

4. The method of claim 1, wherein applying the treatment fluid comprises applying a matrix treatment fluid.

5. The method of claim 1, wherein applying the treatment fluid comprises applying at least one of acid, chelant, solvent, surfactant, brine, oil, and enzyme.

6. The method of claim 1, wherein creation of the local transient underbalance causes performance of a surge operation to clean the tunnels, the method further comprising performing a fracture operation after the surge operation.

7. The method of claim 6, further comprising performing a gravel pack operation after the fracture operation.

8. The method of claim 1, wherein creating the local transient underbalance causes performance of a surge operation to clean the tunnels, the method further comprising performing a gravel pack operation.

9. The method of claim 1, wherein applying the treatment fluid comprises activating an applicator tool to apply the treatment fluid.

10. The method of claim 9, wherein activating the applicator tool comprises opening at least one port of the applicator tool.

11. The method of claim 1, wherein applying the treatment fluid comprises applying the treatment fluid in presence of an overbalance condition.

12. The method of claim 1, wherein applying the treatment fluid comprises applying a brine to reduce surface tension within the tunnels.

13. The method of claim 1, wherein applying the treatment fluid comprises applying a surfactant to enhance the transport of debris out of the tunnels.

14. The method of claim 1, wherein applying the treatment fluid comprises applying a fluid to enhance cleanup of the tunnels.

15. The method of claim 1, further comprising applying a sequence of pressure conditions in the wellbore interval, the sequence of pressure conditions comprising the transient underbalance condition and other pressure conditions.

16. The method of claim 15, wherein applying the other pressure conditions comprises applying at least one of an underbalance condition, overbalance condition, and balanced condition.

17. A method for use in a wellbore, comprising:

causing creation of tunnels in surrounding formation of a well interval;

applying treatment fluid to the tunnels;

creating a local transient underbalance condition in the well interval after creation of the tunnels in the formation and application of the treatment fluid, wherein applying the treatment fluid comprises applying the treatment fluid in presence of an overbalance condition; and activating a perforating gun to create the overbalance condition, the overbalance condition comprising a transient overbalance condition.

18. The method of claim 17, wherein activating the perforating gun comprises activating a tubing conveyed perforating gun.

19. The method of claim 17, wherein applying the treatment fluid comprises applying an acid to flow into the tunnels due to the presence of the overbalance condition.

20. The method of claim 19, wherein applying the acid comprises flowing a substantially equal amount of acid into each of the tunnels.

21. A method for use in a wellbore, comprising:

causing creation of tunnels in surrounding formation of a well interval;

applying treatment fluid to the tunnels; and creating a local transient underbalance condition in the well interval after creation of the tunnels in the formation and application of the treatment fluids, wherein applying the treatment fluid comprises controlling a rate of application of the treatment fluid using a time release mechanism that is part of an applicator tool lowered into the wellbore.

* * * * *